US010316842B2

(12) United States Patent
Oshiro

(10) Patent No.: US 10,316,842 B2
(45) Date of Patent: Jun. 11, 2019

(54) AIR COMPRESSOR

(71) Applicant: Hitachi Industrial Equipment Systems Co., Ltd., Chiyoda-ku, Tokyo (JP)

(72) Inventor: Ryusuke Oshiro, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 320 days.

(21) Appl. No.: 15/123,352

(22) PCT Filed: Mar. 13, 2015

(86) PCT No.: PCT/JP2015/057566
§ 371 (c)(1),
(2) Date: Sep. 2, 2016

(87) PCT Pub. No.: WO2015/141596
PCT Pub. Date: Sep. 24, 2015

(65) Prior Publication Data

US 2017/0067465 A1 Mar. 9, 2017

(30) Foreign Application Priority Data

Mar. 20, 2014 (JP) ..... 2014-058828

(51) Int. Cl.
*F04C 28/06* (2006.01)
*F04C 28/24* (2006.01)
(Continued)

(52) U.S. Cl.
CPC ..... *F04C 28/06* (2013.01); *F04B 39/10* (2013.01); *F04C 18/16* (2013.01); *F04C 28/24* (2013.01);
(Continued)

(58) Field of Classification Search
CPC ..... F04B 39/10; F04C 28/06; F04C 18/16; F04C 28/24; F04C 28/28; F04C 29/0007;
(Continued)

(56) References Cited

U.S. PATENT DOCUMENTS 4,863,355 A 9/1989 Odagiri et al.
5,979,160 A * 11/1999 Yashiki ..... F01N 11/007 60/276
(Continued)

FOREIGN PATENT DOCUMENTS

JP 63-235677 A 9/1988
JP 11-230053 A 8/1999
(Continued)

OTHER PUBLICATIONS

English Translation of JP 11-230053 Obtained Sep. 10, 2018 (Year: 2018).*
(Continued)

*Primary Examiner* — Dominick L Plakkoottam
*Assistant Examiner* — Connor J Tremarche
(74) *Attorney, Agent, or Firm* — Crowell & Moring LLP

(57) ABSTRACT

To provide an air compressor capable of achieving energy saving. The air compressor is provided with a compressor body compressing air with injecting oil into a compression chamber; an air-pressure-operated intake throttle valve provided on an intake side of the compressor body; a separator provided on a delivery side of the compressor body and separating, from the compressed air delivered from the compressor body, a liquid contained in the compressed air; a compressed air system supplying the compressed air separated by the separator to a supply destination; an air release system connected to a primary side of a check valve in the compressed air system; an air-pressure-operated air release valve provided in the air release system; and an
(Continued)

air-pressure operation circuit having a solenoid-operated three-way valve.

3 Claims, 6 Drawing Sheets

(51) Int. Cl.

| | |
|---|---|
| ***F04C 29/12*** | (2006.01) |
| ***F04C 29/02*** | (2006.01) |
| ***F04C 28/28*** | (2006.01) |
| ***F04C 18/16*** | (2006.01) |
| ***F04C 29/00*** | (2006.01) |
| ***F04B 39/10*** | (2006.01) |

(52) U.S. Cl.
CPC ..... *F04C 28/28* (2013.01); *F04C 29/0007* (2013.01); *F04C 29/026* (2013.01); *F04C 29/124* (2013.01); *F04C 2210/1005* (2013.01); *F04C 2240/30* (2013.01)

(58) Field of Classification Search
CPC ..... F04C 29/026; F04C 29/14; F04C 2210/1005; F04C 2240/30
USPC ..... 417/295
See application file for complete search history.

(56) References Cited

U.S. PATENT DOCUMENTS

2009/0255406 A1* 10/2009 Sakatani ..... B01D 45/12 96/361
2013/0199504 A1 8/2013 Takeishi et al.

FOREIGN PATENT DOCUMENTS

| | | | | |
|---|---|---|---|---|
| JP | 11230053 | A | * | 8/1999 |
| JP | 2006-57489 | A | | 3/2006 |
| JP | 2006057489 | A | * | 3/2006 |
| JP | 2007-177670 | A | | 7/2007 |
| JP | 2007177670 | A | * | 7/2007 |
| JP | 2011-99348 | A | | 5/2011 |
| JP | 2013-160108 | A | | 8/2013 |

OTHER PUBLICATIONS

English Translation of JP 2007-177670 Obtained Sep. 10, 2018 (Year: 2018).*
English Translation of JP 2006-057489 Obtained Sep. 10, 2018 (Year: 2018).*
International Preliminary Report of Patentability (PCT/IB/338 & PCT/IB/373) issued in PCT Application No. PCT/JP2015/057566 dated Sep. 29, 2016 including the English translation of previously submitted document C2 (Japanese-language Written Opinion (PCT/ISA/237) filed on Sep. 2, 2016) (Eight (8) pages).
International Search Report (PCT/ISA/210) issued in PCT Application No. PCT/JP2015/057566 dated Jun. 9, 2015 with English translation (Four (4) pages).
Japanese-language Written Opinion (PCT/ISA/237) issued in PCT Application No. PCT/JP2015/057566 dated Jun. 9, 2015 (Four (4) pages).

* cited by examiner

AIR COMPRESSOR

TECHNICAL FIELD

The present invention relates to a liquid supplying air compressor and particularly relates to an air compressor provided with an intake throttle valve and an air release valve.

BACKGROUND ART

An oil supplying screw compressor, for instance, which is one of liquid supplying air compressors, is provided with a compressor body that has a pair of male and female screw rotors and is configured to inject oil into a compression chamber for purposes of cooling the heat of compression, improving the sealability of the compression chamber, and lubrication of the screw rotors. Compressed air that has been compressed to a predetermined pressure in the compression chamber of the compressor body is delivered in a state of being mixed with the oil. After the oil has been separated from the compressed air by a separator, the resulting compressed air is supplied to a user's destination via a compressed air system. The separated oil is temporarily accumulated in a lower portion of the separator and then supplied to the compressor body via an oil system by an internal pressure of the separator. Namely, the oil circulates between the compressor body and the separator.

The air compressor adopts a scheme for controlling a capacity in response to a utilization state of the compressed air, with a view to power reduction. Specifically, for instance, an intake throttle valve is provided on an intake side of the compressor body, an air release system is provided to be connected to a primary side of a check valve in the compressed air system (in other words, a secondary side of the separator), and an air release valve is provided in this air release system. Furthermore, a pressure sensor is provided on a secondary side of the check valve in the compressed air system. For instance, when the quantity of the used compressed air falls and the pressure detected by the pressure sensor reaches a predetermined upper limit, a mode of the air compressor is switched to either a no-load operation mode or an automatic stop mode and the supply of the compressed air is stopped. In the no-load operation mode and the automatic stop mode, the following controls are exerted.

In the no-load operation mode, the intake throttle valve is closed while the compressor body continues to operate without stopping a motor. Furthermore, the air release valve is opened to release the compressed air, and the pressure on the primary side of the check valve in the compressed air system, that is, the internal pressure of the separator is reduced to some extent. Subsequently, when the pressure detected by the pressure sensor falls to a predetermined lower limit, the mode is switched to a load operation mode. In other words, the intake throttle valve is opened and the air release valve is closed.

In the automatic stop mode, the motor is stopped to stop the compressor body. Furthermore, the air release valve is opened to release the compressed air, and the pressure on the primary side of the check valve in the compressed air system, that is, the internal pressure of the separator is reduced nearly to an atmospheric pressure. Moreover, the intake throttle valve is closed in order to prevent the oil within the compressor body from flowing backward and then to the primary side of the intake throttle valve. Subsequently, when the pressure detected by the pressure sensor falls to the predetermined lower limit, the mode is switched to the load operation mode. In other words, the motor is driven to restart operation of the compressor body. Furthermore, the intake throttle valve is opened and the air release valve is closed.

In this case, if the time from stop to restart of the compressor body is short, the internal pressure of the separator falls insufficiently, and the residual pressure thereof causes starting congestion of the compressor body. Owing to this, a time limit from the stop of the compressor body until the compressor body becomes restartable is set, and the compressor body is restarted after this time limit has elapsed.

Note that Patent Document 1, for instance, uses an air-pressure-operated intake throttle valve and a solenoid-operated air release valve.

PRIOR ART DOCUMENT

Patent Document

Patent Document 1: JP-2011-99348-A

SUMMARY OF THE INVENTION

Problem to be Solved by the Invention

In the no-load operation mode, it is preferred to increase a descending speed of the internal pressure of the separator in order to reduce power. Furthermore, in the automatic stop mode, it is preferred to increase the descending speed of the internal pressure of the separator in order to shorten the abovementioned time limit. For these reasons, the air release valve needs to have a magnitude to a certain degree, and when the solenoid-controlled air release valve is employed as disclosed in, for instance, Patent Document 1, a necessary electromagnetic force and eventually power consumption increase. There has been, thus, room for improvement in energy saving.

The present invention has been made in light of the abovementioned circumstances and it is one object to achieve the energy saving.

Means for Solving the Problems

To achieve the abovementioned object, the invention set forth in claims is employed. An air compressor includes: a compressor body compressing air with injecting a liquid into a compression chamber; an air-pressure-operated intake throttle valve provided on an intake side of the compressor body; a separator provided on a delivery side of the compressor body, the separator separating, from the compressed air delivered from the compressor body, the liquid contained in the compressed air; a compressed air system supplying the compressed air separated by the separator to a supply destination; a check valve provided in the compressed air system; an air release system connected to a primary side of the check valve in the compressed air system; an air-pressure-operated air release valve provided in the air release system; an air-pressure operation circuit that has at least one solenoid-operated three-way valve, selects one of the primary side of the check valve in the compressed air system and a primary side of the intake throttle valve to make the selected primary side communicate with an operation chamber of the intake throttle valve, and selects one of the primary side of the check valve in the compressed air system and the primary side of the intake throttle valve to make the selected primary side communicate with an operation chamber of the air release valve; a pressure sensor provided on a secondary side of the check valve in the compressed air system; and a control unit controlling the three-way valve by switching a mode to any one of a load operation mode, a no-load operation mode, and an automatic stop mode in response to a pressure detected by the pressure sensor.

Effect of the Invention

According to the present invention, the air compressor employs the air-pressure-operated air release valve and has the solenoid-operated three-way valve that constitutes the air-pressure operation circuit. However, this three-way valve is sufficiently smaller than the air release valve; thus, it is possible to reduce a necessary electromagnetic force and eventually power consumption. Therefore, compared with a case where the air compressor employs a solenoid-operated air release valve, it is possible to achieve energy saving.

Other objects and advantages of the present invention will become further obvious from the following disclosure.

MODES FOR CARRYING OUT THE INVENTION

Embodiments of the present invention will be described hereinafter while taking as an example an oil supplying air compressor that is one of objects to which the present invention is applied.

A first embodiment of the present invention will be described with reference to FIGS. 1 to 3.

Figure 1:
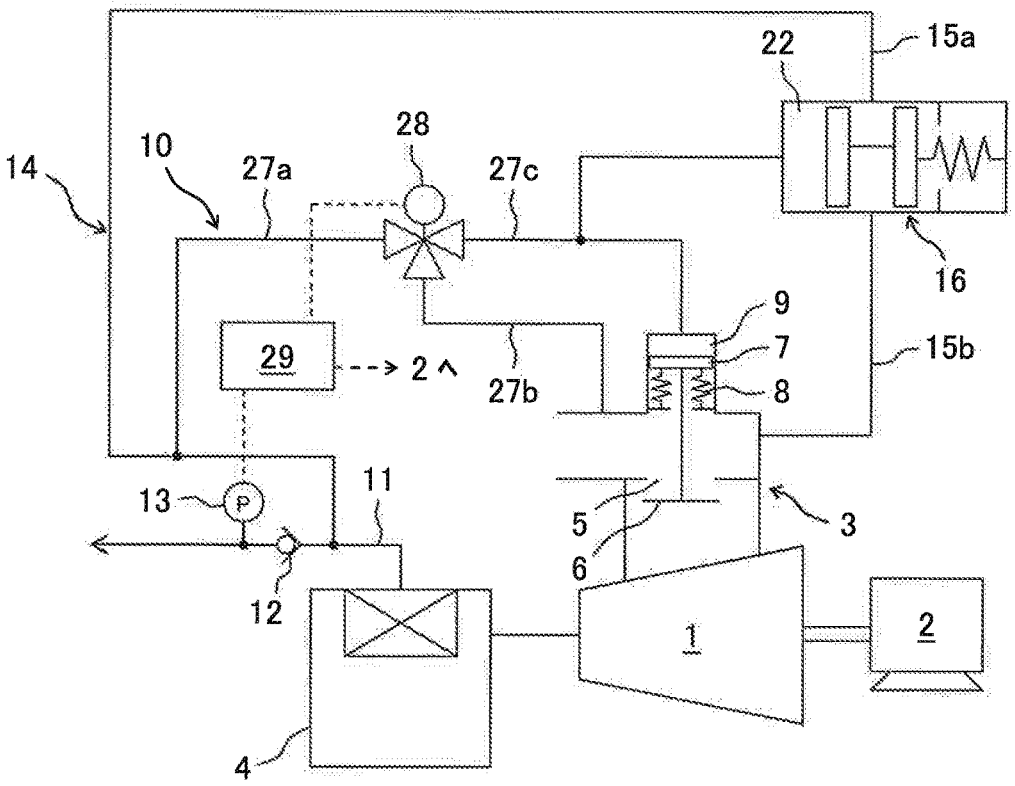
FIG. 1 is a schematic diagram representing a configuration of an oil supplying air compressor according to a first embodiment of the present invention.

FIG. 1 is a schematic diagram representing a configuration of an oil supplying air compressor according to the present embodiment. Note that a broken line part in FIG. 1 denotes electric wiring. FIGS. 2 and 3 are cross-sectional views each representing a structure of an air-pressure-operated air release valve according to the present embodiment, FIG. 2 shows that the air release valve is in a fully closed state, and FIG. 3 shows that the air release valve is in a fully opened state.

The air compressor is provided with a compressor body 1 that compresses air, a motor 2 that drives this compressor body 1, an air-pressure-operated intake throttle valve 3 provided on an intake side of the compressor body 1, an intake filter (not shown) provided on an upstream side of this intake throttle valve 3, and a separator 4 provided on a delivery side of the compressor body 1.

The intake throttle valve 3 has a valve body 6 that opens/closes a valve seat 5, a piston 7 connected to this valve body 6, a spring 8 provided on one side, in the moving direction, of this piston 7 (lower side in FIG. 1), and an operation chamber 9 formed on the other side, in the moving direction, of the piston 7 (upper side in FIG. 1).

When an air-pressure operation circuit 10 (described later in detail) increases a pressure of the operation chamber 9 of the intake throttle valve 3, the piston 7 and the valve body 6 surpass a force of the spring 8 to move to the one side and the valve seat 5 is opened. On the other hand, when the air-pressure operation circuit 10 reduces the pressure of the operation chamber 9 of the intake throttle valve 3, the force of the spring 8 causes the piston 7 and the valve body 6 to move to the other side and the valve seat 5 is closed. An air intake amount of the compressor body 1 and eventually a load thereof are thereby adjusted.

Although not shown in detail, the compressor body 1 may have a pair of male and female screw rotors and a casing that accommodates the screw rotors therein, and compression chambers are formed between tooth grooves of the screw rotors and the casing. Oil supplied from the separator 4 is injected into the compression chamber, where the air is compressed.

The separator 4 is composed of a separation mechanism (more specifically, a centrifugal separation mechanism or a filter separation mechanism, for example) that separates, from the compressed air delivered from the compressor body 1, the oil contained in the compressed air, and a tank that accumulates therein the oil separated by this separation mechanism. An oil system (not shown) is connected to the separator 4, and also has a cooler and the like (not shown). The oil system is configured to supply the oil accumulated in the separator 4 to the compression chamber of the compressor body 1 by an internal pressure of the separator 4. Note that in a no-load operation mode, to be described later, the internal pressure of the separator 4 falls to, for instance, about 0.2 MPa but a sufficient quantity of oil is supplied to the compression chamber of the compressor body 1.

A compressed air system 11 is connected to the oil separator 4. The compressed air system 11 is configured to supply the compressed air separated by the separator 4 to a user side. A check valve 12 is provided in the compressed air system 11, and a pressure sensor 13 is provided on a secondary side of the check valve 12. A drier and the like (not shown) are also provided on the secondary side of the check valve 12.

Furthermore, an air release system 14 (air release flow passages 15*a*, 15*b*) is connected between a primary side of the check valve 12 in the compressed air system 11 (in other words, a secondary side of the separator 4) and a primary side of the intake throttle valve 3 (more specifically, a primary side of the valve seat 5). An air-pressure-operated air release valve 16 is provided in the air release system 14.

Figure 2:
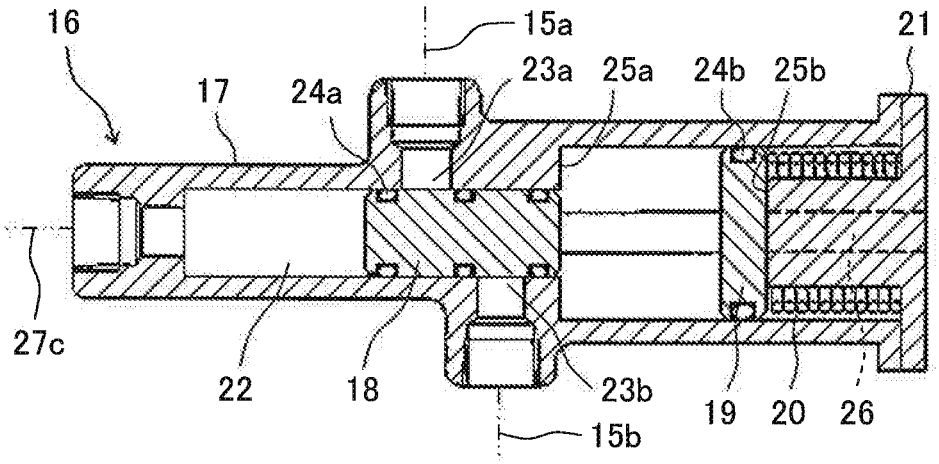
FIG. 2 is a cross-sectional view representing a structure of an air-pressure-operated air release valve according to the first embodiment of the present invention and shows that the air release valve is in a fully closed state.
Figure 3:
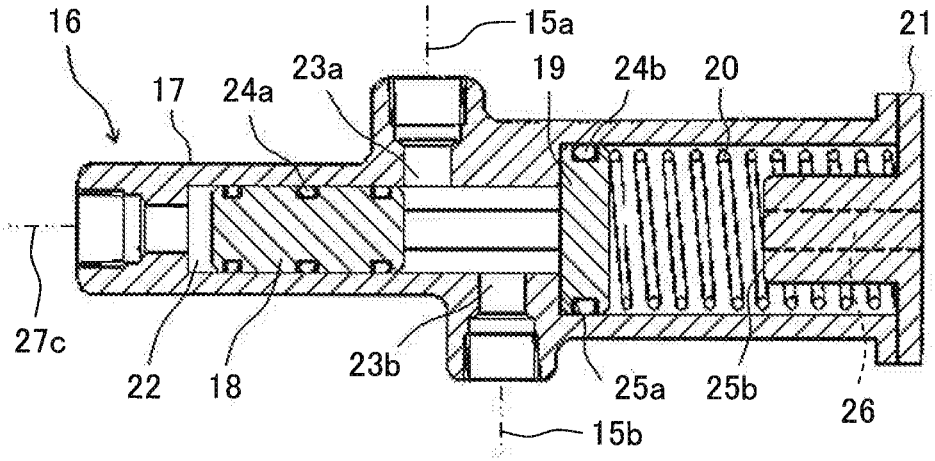
FIG. 3 is a cross-sectional view representing the air-pressure-operated air release valve according to the first embodiment of the present invention and shows that the air release valve is in a fully opened state.

The air release valve 16 has a body 17, a spool (valve body) 18 slidable within this body 17, a piston 19 connected to one side, in the moving direction, of this spool 18 (right side in FIGS. 2 and 3), a spring 20 provided on one side, in the moving direction, of the piston 19, a lid 21 that supports this spring 20, and an operation chamber 22 formed on the other side, in the moving direction, of the spool 18 (left side in FIGS. 2 and 3).

An inlet port 23*a* and an outlet port 23*b* are formed in the body 17, and are connected to the air release flow passages 15*a* and 15*b*, respectively. Furthermore, the ports 23*a* and 23*b* are apart from each other in the moving direction of the spool 18, and a cross-section of a flow passage formed between the ports 23*a* and 23*b* is larger than a cross-section of each port.

O-rings 24*a* and 24*b* are provided on outer circumferential sides of the spool 18 and the piston 19. Stopper parts 25*a* and 25*b* that restrict a moving range of the piston 19 (and eventually a moving range of the spool 18) are formed in the body 17 and the lid 21. A hole 26 for air vent of a spring chamber is formed in the lid 21.

When the air-pressure operation circuit 10 increases the pressure of the operation chamber 22 of the air release valve 16 up to, for example, 0.12 MPa, the spool 18 and the piston 19 surpass a force of the spring 20 and start moving to the one side. Furthermore, when the pressure of the operation chamber 22 of the air release valve 16 becomes, for example, equal to or higher than 0.22 MPa, the piston 19 is made into a state of contacting the stopper part 25*b*, and the spool 18 closes the flow passage between the ports 23*a* and 23*b* (fully closed state) as shown in FIG. 2. On the other hand, when the air-pressure operation circuit 10 reduces the pressure of the operation chamber 22 of the air release valve 16 to, for example, be lower than 0.12 MPa, the force of the spring 20 causes the spool 18 and the piston 19 to move to the other side, the piston 19 is made into a state of contacting the stopper part 25*a* to open the flow passage between the ports 23*a* and 23*b* (fully opened state) as shown in FIG. 3. As a result, the compressed air is released from the primary side of the check valve 12 in the compressed air system 11 (in other words, the secondary side of the separator 4) to the primary side of the intake throttle valve 3 via the air release system 14, thereby reducing the internal pressure of the separator 4.

The air-pressure operation circuit 10 is composed of a flow passage 27*a* connected to the primary side of the check valve 12 in the compressed air system 11, a flow passage 27*b* connected to the primary side of the intake throttle valve 3, a flow passage 27*c* connected to the operation chamber 9 of the intake throttle valve 3 and the operation chamber 22 of the air release valve 16, and a solenoid-operated three-way valve 28 that selects one of the flow passages 27*a* and 27*b* and makes the selected flow passage communicate with the flow passage 27*c*. The three-way valve 28 is controlled by a control unit 29.

The control unit 29 switches among a load operation mode, a no-load operation mode, and an automatic stop mode in response to a pressure, which has been detected by the pressure sensor 13, on the secondary side of the check valve 12 in the compressed air system 11. In the load operation mode, the no-load operation mode, and the automatic stop mode, the following controls are exerted.

In the load operation mode, the control unit 29 drives the motor 2 to cause the compressor body 1 to operate. Furthermore, the control unit 29 turns the three-way valve 28 into a current-carrying state to make the flow passage 27*a* communicate with the flow passage 27*c*. As a result, the compressed air from the primary side of the check valve 12 in the compressed air system 11 is supplied to the operation chamber 9 of the intake throttle valve 3 and the operation chamber 22 of the air release valve 16, thereby increasing the pressure in the operation chamber 9 and the operation chamber 22. Therefore, the intake throttle valve 3 is made into a fully opened state and the air release valve 16 is made into a fully closed state.

The control unit 29 determines whether the pressure detected by the pressure sensor 13 has reached a predetermined upper limit during the load operation mode. For instance, when the pressure detected by the pressure sensor 13 has not reached the predetermined upper limit, the control unit 29 continues the load operation mode. On the other hand, for instance, when the pressure detected by the pressure sensor 13 has reached the predetermined upper limit, the control unit 29 switches the load operation mode to either the no-load operation mode or the automatic stop mode. Generally, the load operation mode is switched first to the no-load operation mode and after predetermined time has elapsed, the no-load operation mode is switched to the automatic stop mode. Nevertheless, when some sort of conditions is satisfied, the load operation mode may be directly switched to the automatic stop mode without via the no-load operation mode.

In the no-load operation mode, the control unit 29 causes the compressor body 1 to continue operating without stopping the motor 2. Furthermore, the control unit 29 turns the three-way valve 28 into a no-current-carrying state to make the flow passage 27*b* communicate with the flow passage 27*c*. As a result, the operation chamber 9 of the intake throttle valve 3 and the operation chamber 22 of the air release valve 16 release the compressed air to the primary side of the intake throttle valve 3, thereby reducing the pressure in the operation chamber 9 and the operation chamber 22 nearly to the atmospheric pressure. Therefore, the intake throttle valve 3 is made into the fully closed state and the air release valve 16 is made into the fully opened state. Furthermore, the internal pressure of the separator 4 falls to, for example, about 0.2 MPa.

In the automatic stop mode, the control unit 29 stops the motor 2 to stop the compressor body 1. Furthermore, the control unit 29 turns the three-way valve 28 into a non-current-carrying state to make the flow passage 27*b* communicate with the flow passage 27*c*. As a result, the operation chamber 9 of the intake throttle valve 3 and the operation chamber 22 of the air release valve 16 release the compressed air to the primary side of the intake throttle valve 3, thereby reducing the pressure in the operation chamber 9 and the operation chamber 22 nearly to the atmospheric pressure. Therefore, the intake throttle valve 3 is made into the fully closed state and the air release valve 16 is made into the fully opened state. Furthermore, the internal pressure of the separator 4 falls nearly to the atmospheric pressure.

The control unit 29 determines whether the pressure detected by the pressure sensor 13 has reached a predetermined lower limit during the no-load operation mode or the automatic stop mode. For instance, when the pressure detected by the pressure sensor 13 has not reached the predetermined lower limit, the control unit 29 continues the no-load operation mode or the automatic stop mode. On the other hand, for instance, when the pressure detected by the pressure sensor 13 has reached the predetermined lower limit, the control unit 29 switches the no-load operation mode or the automatic stop mode to the load operation mode.

Note that when the internal pressure of the separator 4 falls to, for instance, about 0.2 MPa in the no-load operation mode, the pressure of the air supplied by the air-pressure operation circuit 10 to the operation chamber 22 of the air release valve 16 is also about 0.2 MPa at a time of start of transition from the no-load operation mode to the load operation mode. Owing to this, an energization force of the spring 20 of the air release valve 16 is set smaller than a force of the pressure (about 0.2 MPa) of the air release valve 16 that acts on the spool 18.

In the present embodiment configured as described so far, the air compressor employs the air-pressure-operated air release valve 16 and has the solenoid-operated three-way valve 28 that constitutes the air-pressure operation circuit 10. However, this three-way valve 28 is sufficiently smaller than the air release valve; thus, it is possible to reduce a necessary electromagnetic force and eventually power consumption. Therefore, compared with a case where the air compressor employs the solenoid-operated air release valve, it is possible to achieve energy saving.

Meanwhile, in the automatic stop mode, it is preferred to turn the air release valve 16 into a fully opened state and to increase a flow rate of the released air in order to shorten a time limit since the compressor body 1 is stopped until the compressor body 1 becomes restartable. Furthermore, in the no-load operation mode, it is often preferred to turn the air release valve 16 into the fully opened state and to increase the flow rate of the released air in order to reduce the power. The first embodiment of the present invention is intended to deal with such a case. However, in the no-load operation mode, it is often preferred to turn the air release valve 16 into a throttled state and to reduce the flow rate of the released air in order to ensure the internal pressure of the separator 4 for supplying a sufficient quantity of oil to the compression chamber of the compressor body 1. A second embodiment of the present invention intended to deal with such a case will be described with reference to FIGS. 4 and 5.

Figure 4:
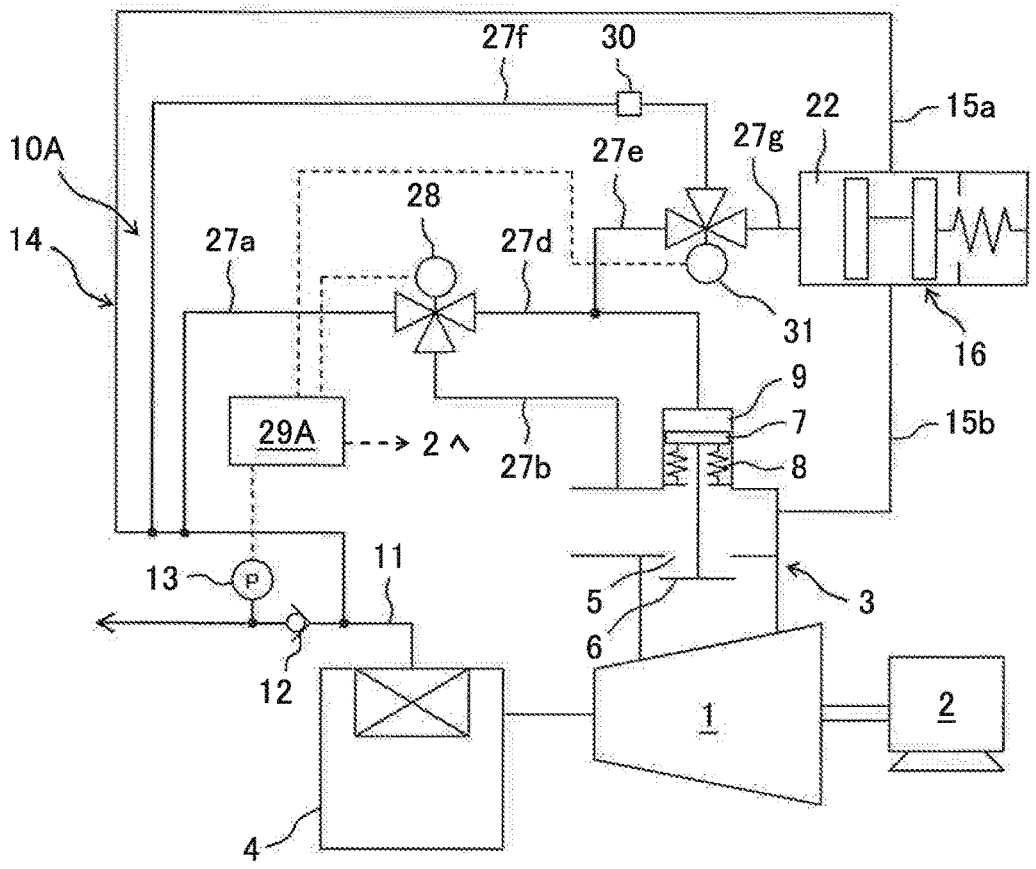
FIG. 4 is a schematic diagram representing a configuration of an oil supplying air compressor according to a second embodiment of the present invention.
Figure 5:
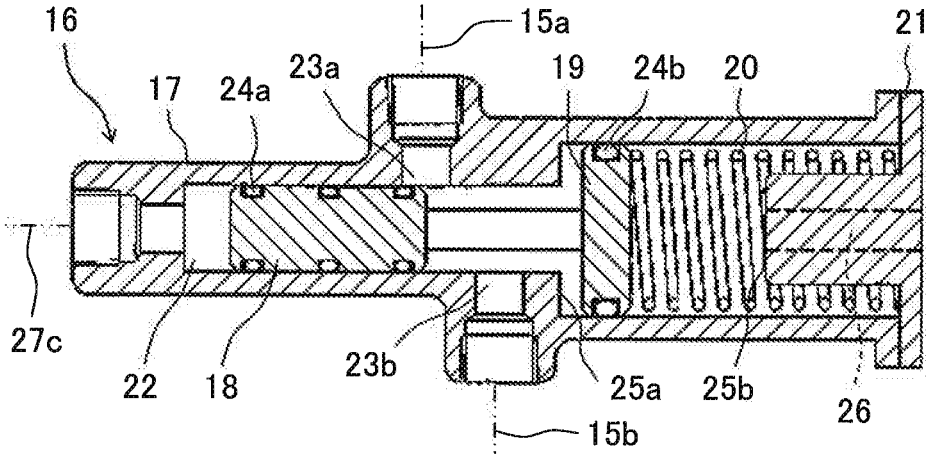
FIG. 5 is a cross-sectional view representing a structure of an air-pressure-operated air release valve according to the second embodiment of the present invention and shows that the air release valve is in a throttled state.

FIG. 4 is a schematic diagram representing a configuration of an air compressor according to the present embodiment. FIG. 5 is a cross-sectional view representing a structure of an air release valve according to the present embodiment and shows that the air release valve is in a throttled state. Note that the same parts as those in the abovementioned first embodiment are denoted by the same reference symbols and are not described, as appropriate.

In the present embodiment, an air-pressure operation circuit 10A has the flow passage 27*a* connected to the primary side of the check valve 12 in the compressed air system 11, the flow passage 27*b* connected to the primary side of the intake throttle valve 3, a flow passage 27*d* connected to the operation chamber 9 of the intake throttle valve 3, and the solenoid-operated three-way valve 28 that selects one of the flow passages 27*a* and 27*b* and makes the selected flow passage communicate with the flow passage 27*d*. Furthermore, the air-pressure operation circuit 10A has a flow passage 27*e* connected to the flow passage 27*d*, a flow passage 27*f* that is connected to the primary side of the check valve 12 in the compressed air system 11 and in which a decompression part 30 (more specifically, a decompression valve, for instance) is interposed, a flow passage 27*g* connected to the operation chamber 22 of the air release valve 16, and a solenoid-operated three-way valve 31 that selects one of the flow passages 27*e* and 27*f* and makes the selected flow passage communicate with the flow passage 27*g*. The three-way valves 28 and 31 are controlled by a control unit 29A.

In the load operation mode, the control unit 29A drives the motor 2 to cause the compressor body 1 to operate. Furthermore, the control unit 29A turns the three-way valve 28 into a current-carrying state to make the flow passage 27*a* communicate with the flow passage 27*d*. As a result, the compressed air from the primary side of the check valve 12 in the compressed air system 11 is supplied to the operation chamber 9 of the intake throttle valve 3 via the flow passages 27*a* and 27*d*, thereby increasing the pressure in the operation chamber 9. Therefore, the intake throttle valve 3 is made into a fully opened state.

At the same time, the control unit 29A turns the three-way valve 31 into a non-current-carrying state to make the flow passage 27*e* communicate with the flow passage 27*g*. As a result, the compressed air from the primary side of the check valve 12 in the compressed air system 11 is supplied to the operation chamber 22 of the air release valve 16 via the flow passages 27*a*, 27*d*, 27*e*, and 27*g*, thereby increasing the pressure in the operation chamber 22. Therefore, the air release valve 16 is made into a fully closed state.

In the automatic stop mode, the control unit 29A stops the motor 2 to stop the compressor body 1. Furthermore, the control unit 29A turns the three-way valve 28 into a non-current-carrying state to make the flow passage 27*b* communicate with the flow passage 27*d*. As a result, the operation chamber 9 of the intake throttle valve 3 releases the compressed air to the primary side of the intake throttle valve 3 via the flow passages 27*b* and 27*d*, thereby reducing the pressure in the operation chamber 9 nearly to the atmospheric pressure. Therefore, the intake throttle valve 3 is made into a fully closed state.

At the same time, the control unit 29A turns the three-way valve 31 into a non-current-carrying state to make the flow passage 27*e* communicate with the flow passage 27*g*. As a result, the operation chamber 22 of the air release valve 16 releases the compressed air to the primary side of the intake throttle valve 3 via the flow passages 27*b*, 27*d*, 27*e*, and 27*g*, thereby reducing the pressure in the operation chamber 22 nearly to the atmospheric pressure. Therefore, the air release valve 16 is made into a fully opened state.

In the no-load operation mode, the control unit 29A causes the compressor body 1 to continue operating without stopping the motor 2. Furthermore, the control unit 29A turns the three-way valve 28 into a non-current-carrying state to make the flow passage 27*b* communicate with the flow passage 27*d*. As a result, the operation chamber 9 of the intake throttle valve 3 releases the compressed air to the primary side of the intake throttle valve 3 via the flow passages 27*b* and 27*d*, thereby reducing the pressure in the operation chamber 9 nearly to the atmospheric pressure. Therefore, the intake throttle valve 3 is made into a fully closed state.

At the same time, the control unit 29A turns the three-way valve 31 into a current-carrying state to make the flow passage 27*f* communicate with the flow passage 27*g*. As a result, the compressed air from the primary side of the check valve 12 in the compressed air system 11 is supplied to the operation chamber 22 of the air release valve 16 via the flow passages 27*f* and 27*g* and the decompression part 30. At this time, the decompression part 30 reduces the pressure of the air from the primary side of the check valve 12 in the compressed air system 11 (more specifically, pressure varying, for instance, from about 0.7 MPa to about 0.2 MPa) to, for instance, about 0.13 MPa. Owing to this, as shown in FIG. 5, the air release valve 16 is made into the throttled state.

In the present embodiment configured as described so far, the number of the solenoid-operated three-way valves is larger than in the abovementioned first embodiment and, therefore, power consumption increases. Notwithstanding, compared with the case where the air compressor employs the solenoid-operated air release valve, it is possible to reduce the power consumption and achieve energy saving.

Furthermore, in the present embodiment, in the automatic stop mode, the air release valve 16 is made into the fully opened state and the flow rate of the released air is increased; therefore, it is possible to shorten the time limit since the compressor body 1 is stopped until the compressor body 1 becomes restartable. On the other hand, in the no-load operation mode, the air release valve 16 is made into the throttled state and the flow rate of the released air is reduced; therefore, the internal pressure of the separator 4 can be stabilized at, for instance, about 0.2 MPa and it is possible to supply a sufficient quantity of oil to the compression chamber of the compressor body 1. It is thereby possible to suppress a temperature increase of the compressed air. As a result, it is possible to suppress an increase in a quantity of drain and suppress the degradation of lives of the members and the oil.

A third embodiment of the present invention will be described with reference to FIGS. 6 and 7.

Figure 6:
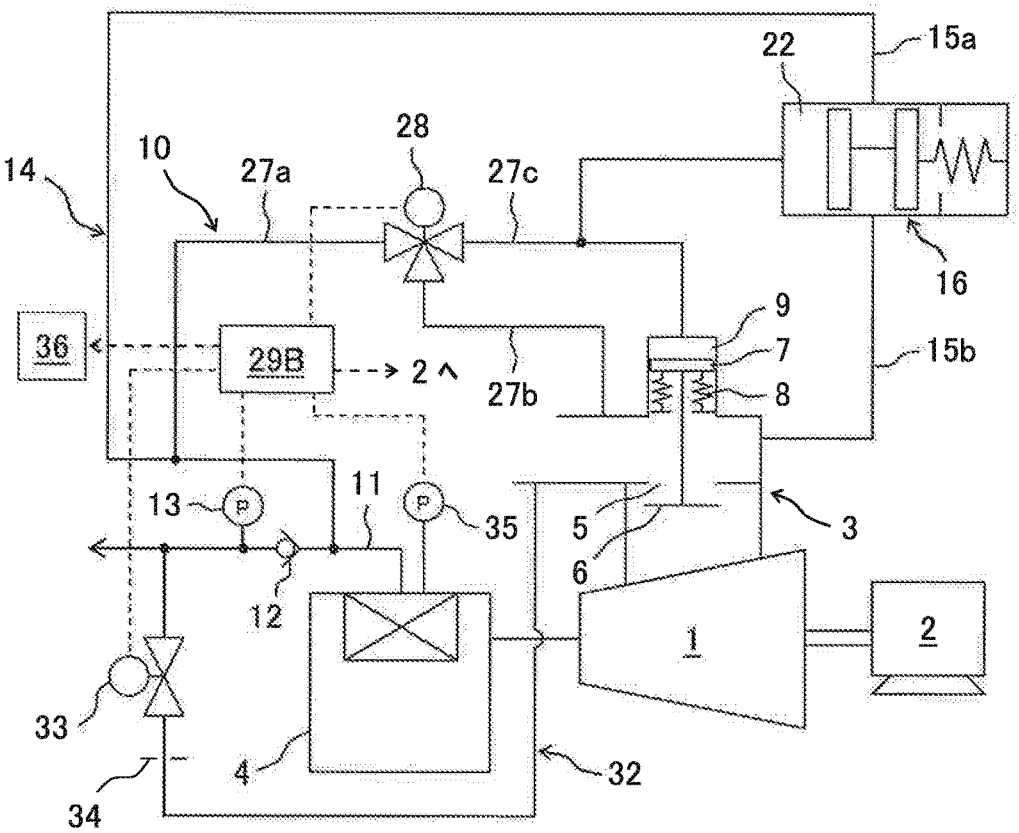
FIG. 6 is a schematic diagram representing a configuration of an oil supplying air compressor according to a third embodiment of the present invention.

FIG. 6 is a schematic diagram representing a configuration of an air compressor according to the present embodiment. Note that the same parts as those in the abovementioned first embodiment are denoted by the same reference symbols and are not described, as appropriate.

In the present embodiment, an emergency air release system 32 is connected between the secondary side of the check valve 12 in the compressed air system 11 and the primary side of the intake throttle valve 3. A solenoid-operated emergency air release valve 33 is provided in the emergency air release system 32 and an orifice 34 is provided on a secondary side of the emergency air release valve 33. The emergency air release valve 33 is normally in a non-current-carrying state and in a closed state.

An abnormality diagnostic pressure sensor 35 is provided on the primary side of the check valve 12 in the compressed air system 11. A control unit 29B has not only the same function as that of the control unit 29 in the first embodiment but also a function to diagnose whether an abnormality has occurred in the normal air release valve 16, on the basis of a detection result of the abnormality diagnostic pressure sensor 35 during the no-load operation mode.

Figure 7:
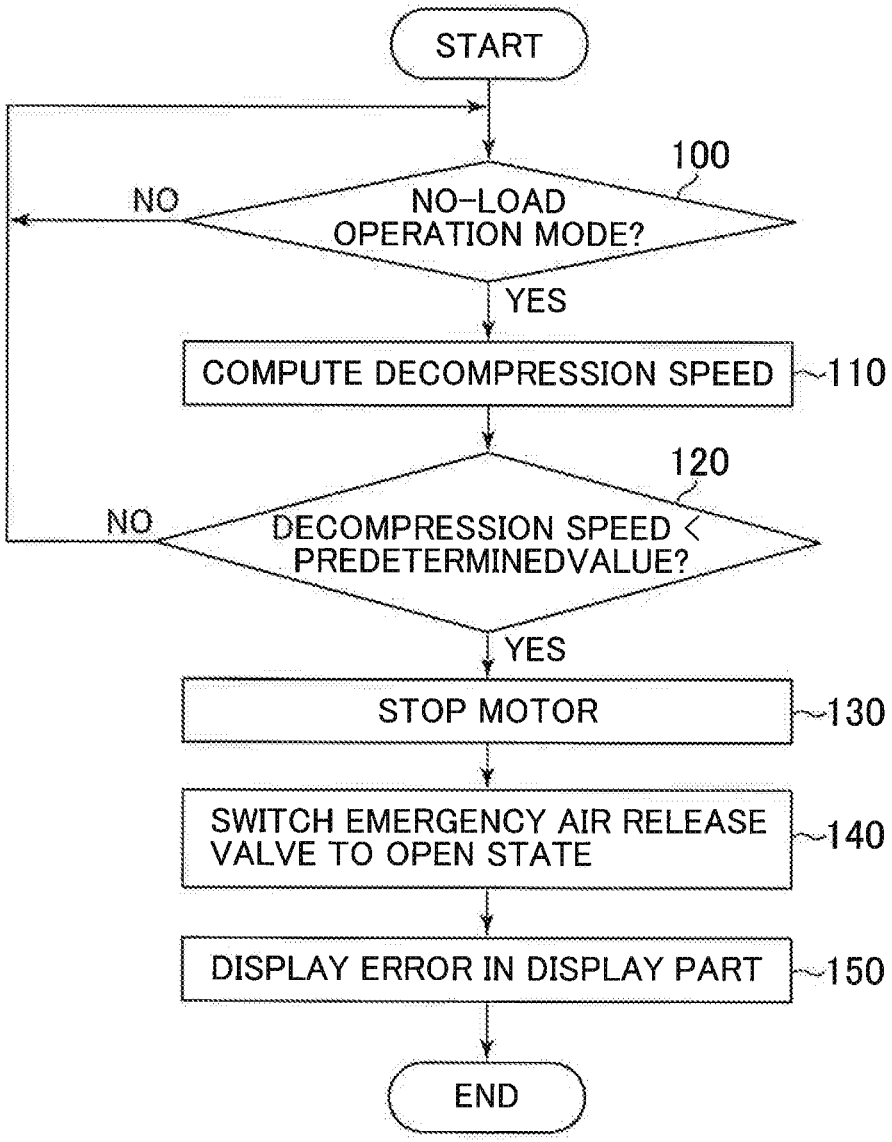
FIG. 7 is a flowchart representing a control processing content associated with an abnormality diagnostic function of a control unit according to the third embodiment of the present invention.

FIG. 7 is a flowchart representing a control processing content associated with the abnormality diagnostic function of the control unit 29B according to the present embodiment.

First, in step 100, it is determined whether the mode has been switched to the no-load operation mode. When the mode has not been switched to the no-load operation mode, a condition for a determination in step 100 is not satisfied and the determination is repeated. On the other hand, when the mode has been switched to the no-load operation mode, the condition for the determination in step 100 is satisfied and processing goes to step 110. In step 110, a decompression speed is computed on the basis of a pressure detected by the abnormality diagnostic pressure sensor 35. The processing goes to step 120, in which it is determined whether the normal air release valve 16 is fixedly made into a closed state by determining whether the decompression speed is lower than a preset, predetermined value.

For instance, when the decompression speed is higher than the predetermined value (in other words, it is determined that the normal air release valve 16 is not fixedly made into the closed state), a condition for a determination in step 120 is not satisfied and similar procedures are repeated back to step 100 mentioned above. On the other hand, for instance, when the decompression speed is lower than the predetermined value (in other words, it is determined that the normal air release valve 16 is fixedly made into the closed state), the condition for the determination in step 120 is satisfied and the processing goes to step 130. In step 130, the motor 2 is stopped and the compressor body 1 is stopped. Furthermore, the processing goes to step 140, in which the emergency air release valve 33 is made into a current-carrying state to be switched to an open state. As a result, the compressed air is released from the secondary side of the check valve 12 in the compressed air system 11 to the primary side of the intake throttle valve 3 via the emergency air release system 32. Moreover, the processing goes to step 150, in which an error is displayed in a display part 36.

In the present embodiment configured as described so far, the air compressor employs the air-pressure-operated normal air release valve 16 and does not normally use the solenoid-operated emergency air release valve 33. Therefore, compared with the case where the air compressor employs the solenoid-operated normal air release valve, it is possible to achieve energy saving.

Furthermore, in the present embodiment, even when the air-pressure-operated normal air release valve 16 is fixedly made into the closed state, the solenoid-operated emergency air release valve 33 can be made into the open state. As a result, maintenance can be conducted to the air compressor.

The third embodiment has been described while taking as an example a case where the air compressor is provided with the air-pressure operation circuit 10 similar to that in the first embodiment; however, the present invention is not limited to this case and the air compressor may be provided with the air-pressure operation circuit 10A similar to that in the second embodiment.

Furthermore, the first to third embodiments have been described while taking a case where the invention is applied to the oil supplying air compressor as an example; however, it goes without saying that the present invention is not limited to this case and may be applied to a water supplying air compressor.

DESCRIPTION OF REFERENCE CHARACTERS

1: Compressor body
3: Intake throttle valve
4: Separator
9: Operation chamber
10, 10A: Air-pressure operation circuit
11: Compressed air system
12: Check valve
13: Pressure sensor
14: Air release system
16: Air release valve
22: Operation chamber
27*a*-27*g*: Flow passage
28: Three-way valve
29, 29A, 29B: Control unit
30: Decompression part
31: Three-way valve
32: Emergency air release system
33: Emergency air release valve
35: Abnormality diagnostic pressure sensor
36: Display part

The invention claimed is:

1. An air compressor comprising:

a compressor body compressing air with injecting a liquid into a compression chamber;

an air-pressure-operated intake throttle valve provided on an intake side of the compressor body;

a separator provided on a delivery side of the compressor body, the separator separating, from the compressed air delivered from the compressor body, the liquid contained in the compressed air;

a compressed air system supplying the compressed air separated by the separator to a supply destination;

a check valve provided in the compressed air system;

an air release system connected to a primary side of the check valve in the compressed air system;

an air-pressure-operated air release valve provided in the air release system;

an air-pressure operation circuit that has at least one solenoid-operated three-way valve, selects one of the primary side of the check valve in the compressed air system and a primary side of the intake throttle valve to make the selected primary side communicate with an operation chamber of the intake throttle valve, and selects one of the primary side of the check valve in the compressed air system and the primary side of the intake throttle valve to make the selected primary side communicate with an operation chamber of the air release valve;

a pressure sensor provided on a secondary side of the check valve in the compressed air system; and a control unit controlling the three-way valve by switching a mode to any one of a load operation mode, a no-load operation mode, and an automatic stop mode in response to a pressure detected by the pressure sensor, wherein the air-pressure operation circuit includes:

a first flow passage connected to the primary side of the check valve in the compressed air system;

a second flow passage connected to the primary side of the intake throttle valve;

a third flow passage connected to the operation chamber of the intake throttle valve;

a solenoid-operated first three-way valve selecting one of the first flow passage and the second flow passage to make the selected flow passage communicate with the third flow passage;

a fourth flow passage connected to the third flow passage;

a fifth flow passage connected to the primary side of the check valve in the compressed air system, a decompression part being interposed in the fifth flow passage;

a sixth flow passage connected to the operation chamber of the air release valve; and a solenoid-operated second three-way valve selecting one of the fourth flow passage and the fifth flow passage to make the selected flow passage communicate with the sixth flow passage, and the control unit is configured to:

in the load operation mode, control the first three-way valve in such a manner that the first flow passage communicates with the third flow passage, control the second three-way valve in such a manner that the fourth flow passage communicates with the sixth flow passage, open the intake throttle valve, and close the air release valve;

in the no-load operation mode, control the first three-way valve in such a manner that the second flow passage communicates with the third flow passage, control the second three-way valve in such a manner that the fifth flow passage communicates with the sixth flow passage, close the intake throttle valve, and open the air release valve in a throttled state; and in the automatic stop mode, control the first three-way valve in such a manner that the second flow passage communicates with the third flow passage, control the second three-way valve in such a manner that the fourth flow passage communicates with the sixth flow passage, close the intake throttle valve, and fully open the air release valve.

2. The air compressor according to claim 1, comprising:

an emergency air release system connected to the secondary side of the check valve in the compressed air system;

a solenoid-operated emergency air release valve provided in the emergency air release system; and an abnormality diagnostic pressure sensor provided on the primary side of the check valve in the compressed air system, wherein the control unit is configured to:

in the no-load operation mode, compute a decompression speed on the basis of a pressure detected by the abnormality diagnostic pressure sensor;

determine whether the air release valve as a normal air release valve is fixedly made into a closed state by determining whether the decompression speed is lower than a preset, predetermined value; and when it is determined that the normal air release valve is fixedly made into the closed state, switch the emergency air release valve from the closed state to an open state.

3. The air compressor according to claim 2, wherein the control unit is configured to display an error in a display part when it is determined that the normal air release valve is fixedly made into the closed state.

* * * * *